United States Patent [19]

Giaccherino

[11] 4,109,420

[45] Aug. 29, 1978

[54] GRINDING MACHINE, PARTICULARLY FOR ROLLERS OF ROLLING ELEMENT BEARINGS

[75] Inventor: Renzo Rossetto Giaccherino, Turin, Italy

[73] Assignee: Famir International S.p.A., Turin, Italy

[21] Appl. No.: 807,615

[22] Filed: Jun. 17, 1977

[51] Int. Cl.[2] ..... B24B 5/04; B24B 41/04

[52] U.S. Cl. ..... 51/105 R; 51/237 R; 82/33 A

[58] Field of Search ..... 51/105 R, 103 C, 237 R, 51/289 R; 82/334, 45

[56] References Cited

U.S. PATENT DOCUMENTS

| | | | |
|---|---|---|---|
| 2,784,534 | 3/1957 | Townsend | 51/237 R |
| 3,159,953 | 12/1964 | Balsiger | 51/237 R |
| 3,574,974 | 4/1971 | Weissing | 51/105 R |
| 3,643,383 | 2/1972 | Asano | 51/105 R |

*Primary Examiner*—N. P. Godici

*Attorney, Agent, or Firm*—Sughrue, Rothwell, Mion, Zinn and Macpeak

[57] ABSTRACT

The grinding machine is of the type adapted for grinding a workpiece having a surface of revolution such as a taper or barrel roller of a rolling element bearing. The two end faces of the workpiece are clamped between adjacent ends of two mandrels which are rotatable about a common axis. The adjacent ends of the two mandrels are formed with respective noses for effecting the clamping of the workpiece. One nose is formed with a seating in the form of a flat face or a concave surface of revolution the axis of which is coincident with the common axis of rotation of the two mandrels. The other nose is provided with a cavity having a tapered opening through which a spring loaded ball partially protrudes. A backup surface of the ball is provided within the cavity perpendicular to the common axis of rotation of the two mandrels over which the ball can roll within the limits imposed by the cavity to facilitate mating of a preliminarily shaped end face of a workpiece with the complementary seating on said one nose in order to accurately locate the workpiece for grinding.

9 Claims, 5 Drawing Figures

GRINDING MACHINE, PARTICULARLY FOR ROLLERS OF ROLLING ELEMENT BEARINGS

BACKGROUND OF THE INVENTION

The present invention relates to a grinding machine, and particularly to a grinding machine for grinding the rollers of rolling element bearings, or similar parts having a generally cylindrical form and two opposed end faces.

Roller bearings intended to carry an axial load as well as a radial load usually have barrel shaped or tapered (i.e. cone-shaped) generally cylindrical rollers, and it is important that the end faces of the rollers, if flat, should be accurately perpendicular to the axis of the curved surface of the roller, or, if they are curved end faces, for example convex or frusto conical, then the axis of the curved end face should coincide as closely as possible with the curved surface of the roller. This will be referred to hereinafter as being 'square', and the term 'out-of-square' will be understood to refer to a roller with flat end faces which are not accurately perpendicular to the axis of the curved surface of the roller, or to a roller with curved end faces in which the axis of the end face is not accurately coincident with the axis of the curved surface of the roller.

It is not possible to grind the surfaces of a roller accurately square (as defined above) with a centreless grinder: such grinders are normally used for grinding the curved surfaces of rollers for which a very high degree of accuracy is not required, since centreless grinding does no more than maintain or accentuate any out-of-squareness of the roughly formed roller.

It is possible to grind rollers square with slightly greater accuracy by machining the workpiece between centres. In order to perform a machining operation of this type both end faces of the roughly formed roller are provided with conical recesses or seats by centre punching. The centre punched recesses receive respective points carried by the chuck and the tailstock of the grinder. However, it is not possible to punch centres with great accuracy and, furthermore, it is not possible to obtain by grinding end faces accurately squared with respect to the axis of the curved surface of the roller ground with the roller turning between the punched centres. The surfaces could be ground more accurately square if the punched centres were ground after they had been punched, but this involves an unacceptable increase in the machining costs. In practice, therefore, grinding between centres can only usefully be employed if very high accuracy is not required, for example with rollers of large dimensions.

Greater accuracy can be obtained by means of the so-called mixed machining; this is machining between a nose provided with a point which engages in a punched centre in one of the end faces of the roughly formed roller and another nose provided with a seat in which engages the other end face of the roller which has first been machined to a convex shape.

Even in this case, however, the convex end face of the roller is hardly ever accurately square with respect to the axis of the punched centre and therefore, in the finished rollers, this end face is still out-of-square with the curved surface of the roller, although the inaccuracy is less than in the case of grinding between centres.

The increase in accuracy obtained by grinding between centres or between one centre and a seat, over that of machining without centres, is not, however, so great as to justify the higher costs arising from the need to punch the centre or centres.

A halving of these costs has already been achieved by means of a grinder which machines simultaneously, between a centre point and a seat, two rollers located in a position offset with respect to the circumference of the grinding wheel, but even so rollers so produced are still not accurately square.

OBJECTS OF THE INVENTION

The object of the present invention is to provide a grinding machine with which it is possible to grind the curved surface of a generally cylindrical bearing roller more accurately square with respect to at least one end face of the roller and more economically than has hithertofore been possible using known methods.

A subsidiary object of the present invention is to provide a grinding machine with which it is possible to grind the curved surface of a generally cylindrical bearing roller accurately square with respect to at least one end face of the roller, without it being necessary to centre punch the said one end face.

SUMMARY OF THE INVENTION

According to the present invention there is provided, in a grinding machine for grinding rollers of rolling element bearings and like generally cylindrical workpieces having first and second opposed end faces, and comprising: a machine bed, first and second supports, carried on said machine bed, first and second mandrels respectively supported on said first and second supports, and axially rotatable about a common axis, said first mandrel being axially fixed with respect to said first support and said second mandrel being axially displaceable with respect to said second support, a first nose on said first mandrel directed towards said second mandrel, a second nose on said second mandrel directed towards said first mandrel, means for driving said first mandrel to rotate about said common axis, means for effecting axial displacement of said second mandrel with respect to said second support, a grinding wheel, grinding wheel support means supporting said grinding wheel for rotation about its axis and for displacement towards and away from a workpiece held between said noses on said first and second mandrels, the improvement comprising a support seat on said first nose of said first mandrel, said support seat having a shape which is a surface of revolution about said common axis of rotation of said two mandrels, for receiving an end face of the workpiece which is shaped with the complementary surface of revolution, an abutment member having a convex surface of contact supported on said second nose of said second mandrel in such a way that it can freely move in all directions in a plane perpendicular to said common axis of rotation of said two mandrels, for engagement with the opposite end face of a workpiece from that engaged by said seat on said first nose of said first mandrel, and means for driving said second mandrel to rotate at the same speed and in the same direction as said first mandrel.

Throughout the present description and in the claims, the expression "surface of revolution" referring to any face of a workpiece to be ground, and to the support seat, must be interpreted in the geometric sense, that is to say, that such a surface, which can be convex, concave or flat, is one which is defined by revolving a straight or curved line about an axis spaced from the line (except in the case of a flat surface of revolution) to generate a surface.

In order to grind a workpiece according to the principles of the invention, one of the opposed end faces of a roughly formed workpiece is ground accurately to a required surface of revolution (for example, a convex, part-spherical shape or a frusto-conical shape; or even accurately flat) and then this workpiece is roughly positioned between the two noses of the cooperating mandrels with the ground end face towards the support seat on the nose of the first mandrel. The second mandrel is then moved axially towards the first one, until the ground end face of the workpiece is pressed into the seat by engagement of its opposite end face with the nose of the movable mandrel. When the workpiece is only lightly engaged it will in general be slightly inclined from the required position with the axis of the end face which engages in the support seat on the first nose of the first mandrel inclined with respect to the common axis of rotation of the two mandrels. The abutment member is located at this stage aligned with the said common axis of rotation of the two mandrels. At this stage the engaged workpiece is tightened by subjecting the second mandrel to a further axial force directed towards the first mandrel. This force produces a bedding movement of the ground end face of the workpiece, which ground end face mates in a centered manner with the support seat, whereby the necessary condition of coincidence of the axis of the ground face with the axis of rotation of the mandrels is obtained.

Normally, the abutment member of the second mandrel will be displaced by this bedding movement, to a position which is eccentric with respect to the axis of rotation of the mandrels and is kept solidly held in this position only by the continued axial force exerted by the second mandrel.

Finally the workpiece, now accurately positioned, is rotated by rotating both the mandrels so that the contacting parts at each end of the workpiece transmit drive thereto. This is important in order to avoid subsequent displacements of the transversely movable abutment member with respect to the common axis of rotation of the two mandrels. The workpiece is then ground by the grinding wheel to the required surface of revolution about the axis of rotation of the two mandrels, so that the ground face is extremely accurately square with respect to the preliminarily ground end face.

Further characteristics and advantages of the invention will become apparent from a reading of the following description of a preferred embodiment of the invention in which reference is made to the accompanying drawings, which description is provided by way of non-restrictive example only.

DESCRIPTION OF THE PREFERRED EMBODIMENT

Figure 1:
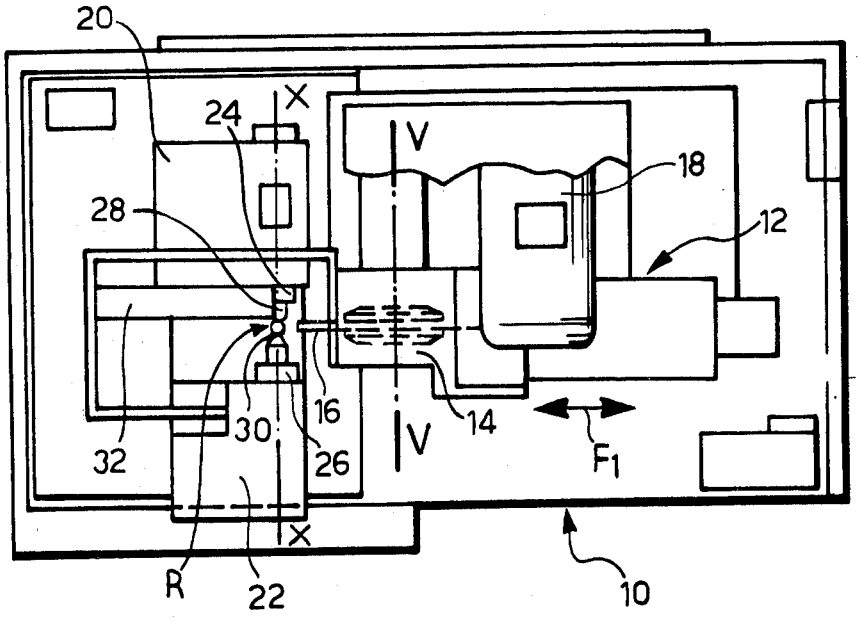
FIG. 1 is a diagrammatic plan view, from above, of a grinding machine formed as an embodiment of this invention.

Referring first to FIG. 1, a grinder according to the invention comprises a bed 10 on which is slidably mounted, for displacement in the directions indicated by the double arrow $F_1$, a slide 12 which supports a grinding wheel head 14 which latter carries a grinding wheel 16 mounted for rotation about an axis V—V perpendicular to the direction of the double arrow $F_1$. The grinding wheel 16 is driven in a known way by means of an electric motor 18 also supported by the slide 12.

On the bed 10 there is also mounted a pair of supports 20 and 22 in which are mounted respective mandrels 24 and 26 which are rotatable about a common axis X—X. The two mandrels 24 and 26 are provided with respective opposed noses 28 and 30, which as will be seen more clearly below, are provided with respective means for engagement with one or the other end faces of a roller R of a rolling element bearing the curved surface of which is to be ground. Between the two supports 20 and 22 there is provided a device 32 for feeding and positioning the rollers to be ground; this device is of a conventional type and operates to feed successive roughly formed rollers into position roughly between the two noses 28 and 30 of the mandrels 24, 26, in such a way that the axis of the roughly formed roller approximately coincides with the axis X—X of rotation of the mandrels 24 and 26. The two supports 20 and 22 are carried by respective slides (not shown) which permit displacement of the supports 20, 22 parallel to the axis X—X of the two mandrels 24, 26. These slides are carried, in turn, by a common table, mounted on the bed 10 and adjustable about an axis perpendicular to the axis X—X of the two mandrels 24, 26 and perpendicular to the axis V—V of the grinding wheel 14 (i.e. a substantially vertical axis) for the purpose of adjusting its angular orientation in a plane defined by the said two axes so that the axis X—X can be located accurately parallel to the axis V—V for the grinding of cylindrical or barrel rollers or adjusted so that the axis X—X is inclined at a certain angle with respect to the axis V—V for the grinding of cone-shaped or taper rollers. The adjustment system for the two supports 20 and 22 is of a conventional type and consequently it has not been shown in detail.

Figure 2:
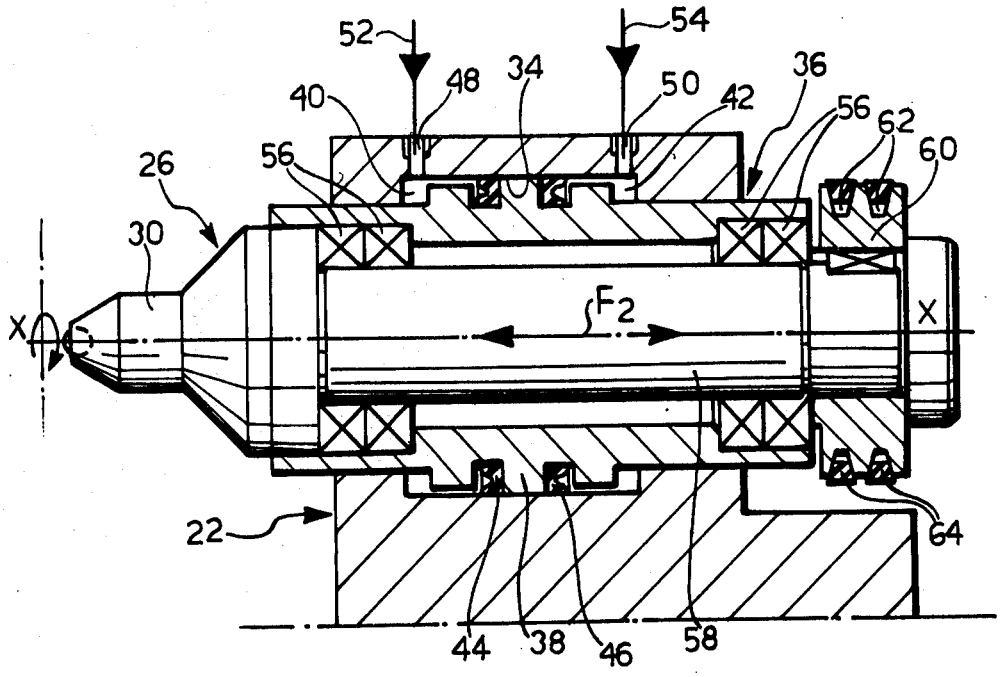
FIG. 2 is an axial section of one of the workpiece supports.

FIG. 2 illustrates the mounting of the mandrel 26 on the support 22. A cylindrical bore 34 paralled to the axis X—X is formed in the support 22 in which is slidably mounted a hollow sleeve 36 having a radially outwardly projecting circumferentially extending ridge 38 on either side of which are located two sealing rings 44, 46. These separate the interior bore 34 of the support 22 into two chambers 40 and 42, the ridge 38 serving as an annular piston in the cylinder 34. The two chambers 40 and 42 have respective ports 48, 50 leading to respective pipe systems, schematically indicated by the reference numerals 52 and 54, through which can be fed, selectively, hydraulic fluid under pressure, to cause displacement of the sleeve 36 by the action of the annular piston 38 axially along the axis X—X in one direction or the other. The extent of this displacement, which is indicated by the double arrow $F_2$, may be up to about one millimeter.

In the sleeve 36 there is rotatably mounted, by means of thrust bearings 56, a shaft 58 which forms part of the mandrel 26. The arrangement of the bearings 56 between the sleeve 36 and the mandrel 26 allow the mandrel 26 and its associated shaft 58 to rotate freely within the sleeve 36. However, upon shifting of the sleeve 36 to the left or right as viewed in FIG. 2, the mandrel 26 and shaft 58 will be entrained for similar movement.

On one end of the shaft 58 there is keyed a pulley 60 which has a pair of toothed V-section grooves 62 in which are engaged respective toothed belts 64 which serve to transmit rotation to the shaft 58 from a synchronous electric motor (not shown). The pulley 60 will, of course, be displaced axially by a small amount with the displacement of the shaft 58 of the mandrel 26, but flexibility of the belts 64 allows such small axial displacements of the pulley 60 to take place without difficulty and with no loss of drive.

The mandrel 24, which is rotatably carried by the support 20, is in fact axially fixed. Like the mandrel 26, however, it can be driven to rotate by a synchronous electric motor identical to the one which drives the mandrel 26, by means of a toothed belt and toothed pulley transmission identical to that associated with the mandrel 26. During the grinding operation, which will be described in more detail below, the above mentioned two synchronous electric motors are operated in exact synchronism by feeding them at the same frequency by means of a well known system, termed a "coupled inverter", to ensure that the two mandrels 24 and 26 rotate at the same speed and in the same direction. This condition of synchronism is essential for the performance of the method of grinding according to the invention.

Figure 3:
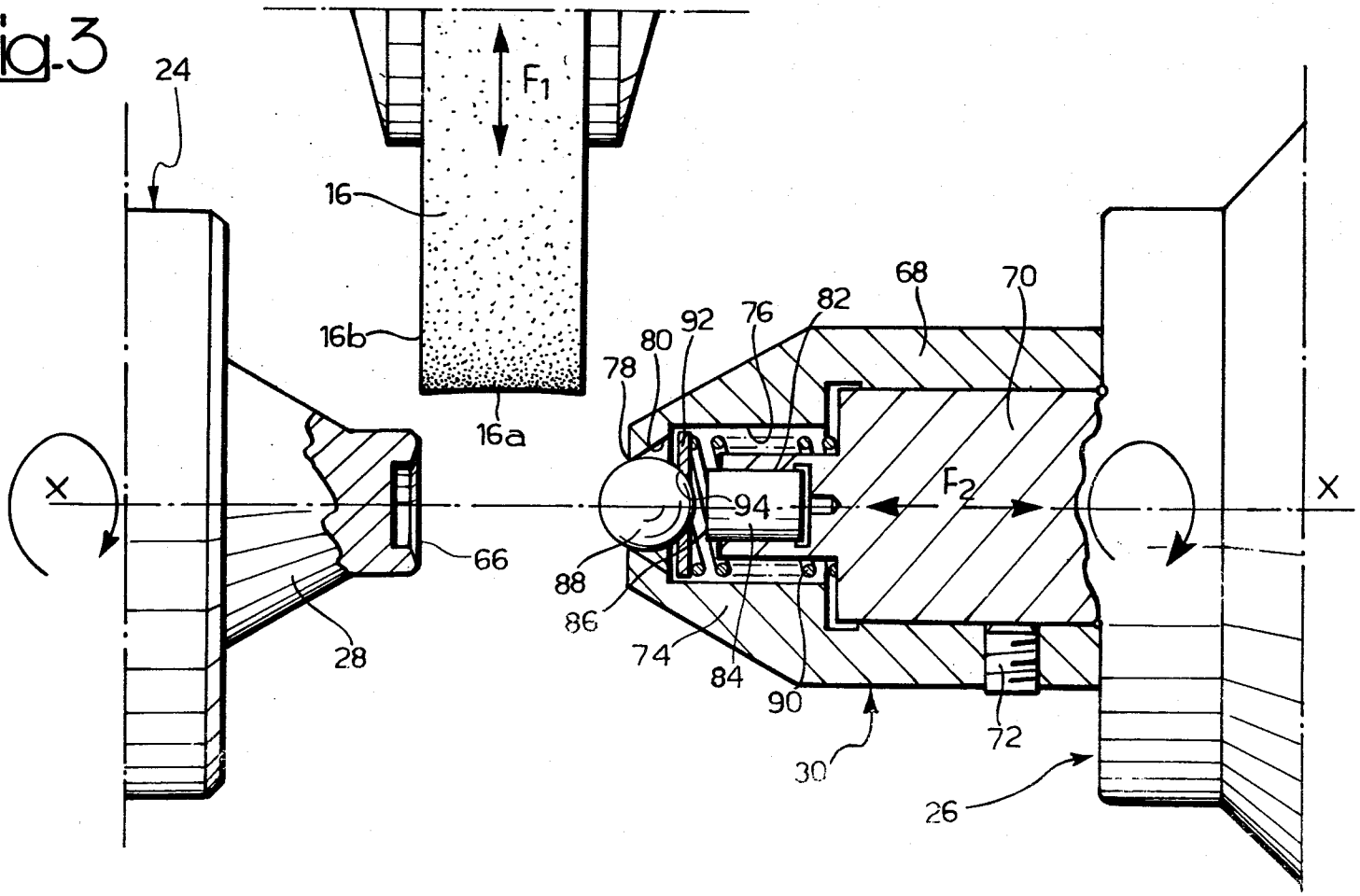
FIG. 3 is a diagrammatic side view, partly in section and on a larger scale than that of FIG. 2, showing the two opposed noses of the workpiece supports and the grinding wheel which grinds the curved surface of a workpiece.

In FIG. 3, in which the components which also appear in FIGS. 1 and 2 are indicated by the same reference numerals, it can be seen that the nose 28 of the mandrel 24 has on its end facing towards the nose 30 of the mandrel 26, a support seat 66 in the form of an annular part spherical surface the centre of curvature of which lies on the axis of rotation X—X of the mandrels 24, 26. In the embodiment illustrated the seat 66 is accurately ground as a part-spherical area since it is intended to receive an end face of a bearing roller which has previously been ground to a convex part-spherical form with the same radius. If it is intended to grind the rollers having an end face of different form the seat 66 will have a different form; for example, if the end faces of the rollers to be ground are conical or frusto-conical, then the seat 66 would have an annular concave frusto-conical form to correspond thereto; likewise if the corresponding end face of the rollers has a flat face, the seat 66 on the nose 28 will preferably be flat, and its plane will be perpendicular to the axis X—X. However, for the purpose of the present invention it is required that in every case the seat 66 on the nose 28 should be coaxially engageable with the end face of a roller which has previously been ground to a selected shape.

The seat 66 could alternatively be formed on a plurality of separate support surfaces instead of as a complete annular surface, provided that the support surfaces all belong to a single curved surface having as its axis the common axis of rotation X—X of the mandrels 24, 26.

The nose 30 of the other mandrel 26 is formed as a hollow body having a cylindrical section 68 and a frusto-conical end section 74. The cylindrical section 68 of the nose is accurately mounted, coaxially with respect to the axis X—X on a cylindrical front stub 70 of the mandrel 26, and the nose 30 is rigidly secured to the stub 70 by means of a grub screw 72 passing through the wall of the cylindrical section 68 and pressing on the stub 70. The frusto-conical end section 74 has a substantially cylindrical internal cavity 76 which opens via a frusto-conical portion 80 into the free end of the nose 30 facing the seat 66 through a circular opening 78 centred on the axis X—X.

The projecting stub 70 of the nose 30 has a hollow cylindrical end portion 82 in which is mounted a small cylindrical block 84 of hard metal, fixed in place, for example by brazing, or by adhesive. The end face of the cylindrical block 84 facing the opening 78 has a flat surface 86 ground with high accuracy so that it is exactly perpendicular to the axis of the stub 70 of the nose 30 and thus to the axis X—X about which the nose 30 rotates. A ball 88 of hard metal of greater diameter than that of the circular opening 78 is trapped within the frusto-conical end section 74 of the nose 30 and projects through the circular opening 78 to some extent. The ball 88 engages against an annular washer 92 the inner opening of which is formed by an annular part-spherical surface matching the surface of the ball 88. The washer 92 is pressed against the ball 88 by a compression spring 90 surrounding the hollow cylindrical end portion 82 of the stub 70 to exert on the ball 88 via the washer 92 an axial thrust to press the ball 88 against the opening 78 in the nose 30.

FIG. 3 also illustrates the position of the grinding wheel 16 with respect to the two noses 28 and 30. In order to grind the curved surface of a roller held between the two noses in a manner which will be more fully explained below the grinding wheel 16 can be advanced toward the space between the two noses in a direction perpendicular to the axis X—X, that is to say in the direction indicated by the double arrow $F_1$. In FIG. 3 the grinding wheel shown is constructed to grind barrel shaped rollers, for which reason it has a working surface **16*a* the profile of which is concave and exactly complementary to the required convex profile to be formed on the surface of the rollers. The grinding wheel 16 is positioned such that as it advances towards a roller held between the noses 28, 30, its side face 16*b* situated on the side adjacent the nose 28 just passes the end face 66 of the nose 28 without actually touching it. The movable mandrel 26 is shown in FIG. 3 in its most retracted position with respect to the nose 28, in which position a roller to be ground can be located easily between the seat 66 of the nose 28 and the ball 88 of the nose 30**.

Figure 4:
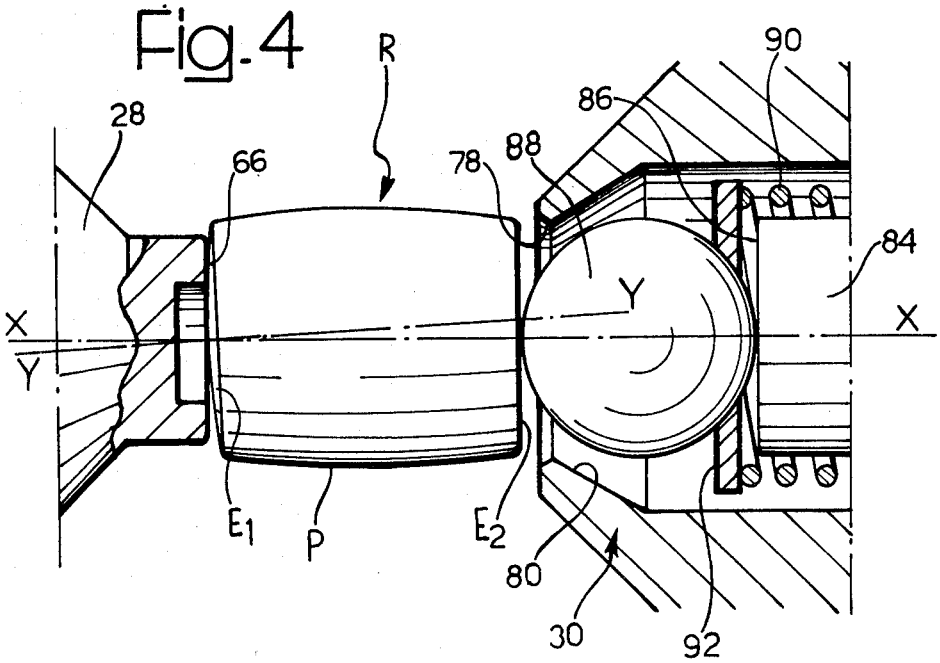
FIGS. 4 and 5 are partially sectioned diagrammatic side views on a larger scale than that of FIG. 3, showing two stages in the setting-up procedure of mounting a barrel roller element between the two noses of the workpiece supports and grinding the curved surface of said roller element.

In order to grind a roller on a grinder according to this invention, one of the two end faces of the roller is preliminarily ground with a curved surface which, in the embodiment illustrated, is a part-spherical surface. FIG. 4 illustrates a barrel-shaped roller R in position between the noses 28, 30. The end face $E_1$ of the roller R has been ground into the form of a part-spherical end cap of large radius corresponding with the radius of the seat 66, in the nose 28. The opposite end face $E_2$ of the roller R is substantially flat and is left in the state in which the roughly formed roller is made.

With the mandrels 24, 26 rotating, a roller R is positioned, for example by means of an automatic feed device, between the noses 28, 30 in such a manner that its axis roughly corresponds to the common axis X—X about which the two mandrels 24, 26 rotate. Then hydraulic fluid under pressure is introduced into the chamber 42 (FIG. 2) to cause the mandrel 26 to advance until it moves the ball 88 into contact with the end face $E_2$ of the roller R, displacing the ball against the spring 90 until the ball 88 is contacted by the flat transverse end face 86 of the small cylindrical block 84 of hard metal. This is the condition illustrated in FIG. 4. The axial movement of the ball 88 with respect to the nose 30 is preferably equal to or less than one millimeter.

Because the curved end face $E_1$ obtained by the preliminary grinding operation could only with great difficulty be formed such that its centre of curvature lies on the longitudinal axis of the roughly formed roller R, and because the roller R has only been roughly positioned between the noses 28, 30 the end face $E_1$ will normally be "out of square" with respect to the axis X—X, that is to say, its centre of curvature lies on an axis Y—Y which almost inevitably is inclined at an angle with respect to the axis X—X as shown in FIG. 4. In these conditions the roller R, held between the ball 88 on the nose 30 and the seat 66 on the nose 28 engages with the seat 66 only over that part of the end face $E_1$ which is most close to the seat 66 (the upper part in the case illustrated in FIG. 4). If the grinding of the curved surface P of the roller R were to be effected in these conditions, the end face $E_1$ would not be square with respect to the rolling surface of the roller and it is essential for a roller intended for use in a precision bearing to be accurately square.

By continuing to feed hydraulic fluid into the chamber 42 to exert on the mandrel 26 and its nose 30 a force urging them towards the other mandrel 24, the roller R is forced to bed itself into the seat 66 which has a mating face complementary to that of the end $E_1$ of the roller R. This is due to the fact that, as can be seen from FIG. 4, a couple is exerted on the roller R between the reaction at the point of contact with the seat 66 and the point of contact on the ball 88. The roller R can turn about the point of contact on the seat 66 due to the fact that the ball 88 can roll over the end face of the cylindrical hard metal block 84 in a direction perpendicular to the axis X—X. When the end face $E_1$ of the roller is pressed into a mating position with the seat 66 the centre of curvature of this face $E_1$ is accurately positioned on the axis X—X since the seat 66 is accurately formed in this way. If the grinding wheel is accurately positioned with respect to the seat 66 on the nose 30, a condition which is easy to fulfil, then upon grinding the workpiece R the surface so ground will be accurately square with the end face $E_1$.

If, instead of being part-spherical the seat 66 and corresponding end face $E_1$ of the roller were flat, the necessary condition of perpendicularity of the end face $E_1$ of the workpiece with respect to the axis X—X would be achieved, although a more accurate positioning of the workpiece would be required to ensure that the axis of the roller R was sufficiently close to the axis X—X to avoid having to remove too much material upon grinding. If the mating face of the seat 66 and the end face $E_1$ of the roller R were frusto-conical surfaces, the mating between these surfaces, obtained by the bedding of the roller resulting from the displacement of the ball 88 over the end face of the block 84, would necessarily bring the axis of the frusto-conical end face of the roller into coincidence with the axis X—X.

It will be appreciated that in order to ensure that bedding of the roller R against the mating face of the seating 66 takes place when the mandrel 26 is advanced towards the mandrel 24 the ball 88 must be mounted in such a way that it can move transversely with respect to the axis X—X once displaced rearwardly away from contact with the hole 78.

Figure 5:
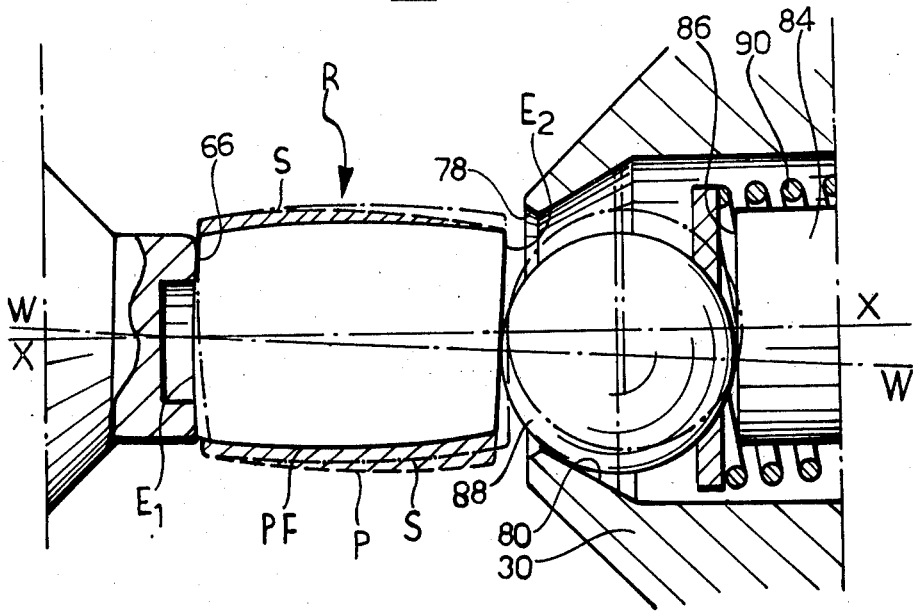

FIG. 5 shows the final position of the roller R, with its end face $E_1$ mating exactly with the seat 66 and with the ball 88 displaced transverse the axis X—X into a stable position with its centre offset with respect to the axis X—X. In this position the axis of the cylindrical surface of the roughly formed roller, indicated by the line W—W is inclined at an angle with respect to the axis X—X. In FIG. 5 the dot and dash lines indicate the positions occupied by the ball 88 and the roller R in FIG. 4, and the dashed lines indicate the profile of the roller R before its surface P has been ground.

In order to grind the surface P of the roller which is clamped in correct position between the seat 66 and the ball 88, the two mandrels 24 and 26 are rotated strictly at the same speed and in the same direction, by means of the "coupled inverter" previously mentioned. The speed of rotation of each of the two mandrels must be exactly the same because if their speeds of rotation were to be different, the ball 88 instead of remaining fixed in its eccentric position with respect to the axis X—X, would rotate in such a way as to cause the roller R to wobble.

The roller R rotates about the axis X—X at the same speed as the two mandrels due mainly to the friction between the end face $E_1$ and the seat 66, but also to the friction between the end face $E_2$ and the ball 88. This friction depends on the axial thrust exerted by the hydraulic fluid in the chamber 42, and this axial thrust may vary from 50 kg, which is suitable for rollers of small dimensions (for example, external diameter of 6 mm; length, 6,8 mm), and 400 kg, which is suitable for rollers of larger dimensions (for example, external diameter 40 mm; length 40–45 mm). The speed of rotation of the two mandrels, and therefore of the roller R is that usually used for high-speed grinding, that is to say, of the order of 3,000–4,000 rpm. Notwithstanding this high rotation speed, there is no danger of displacement of the ball 88 or of the roller R by centrifugal forces because the radii of rotation of these bodies are always of small value.

Whilst the roller R is caused to rotate as described above, the grinding wheel is caused to advance to remove the required amount of excess material, as indicated by the hatched area S of FIG. 5, until the required final profile PF of the surface is obtained. Naturally, the amount by which the roughly formed roller is oversize is so calculated that at the end of the grinding operation the cylindrical surface is fully machined.

Because the finished surface PF is a surface of revolution which has as its axis X—X which is also that of the end face $E_1$ the surfaces PF and $E_1$ are "square" with one another with an accuracy almost equal to that which would be obtained by grinding a roller between accurately ground centres. However, this accuracy has been achieved without first having to provide the rollers with recesses for receiving the centres. Moreover the rollers can be positioned on the machine with sufficient accuracy at a higher speed than that obtainable on a grinding machine provided with centres or with one centre and a seat. For example, on a machine of known type which simultaneously machines two rollers, the grinding cycle of the two rollers, between loading and discharge, requires a total time of 7 seconds, that is to say, 3.5 seconds per roller; whereas on a grinding machine according to the present invention, it is possible to grind an individual roller in a total of 3 seconds.

Naturally, the grinder according to the invention, although primarily designed for grinding rollers of rolling element bearings, can also be used for grinding surfaces of revolution of other kinds of workpieces which required the ground surface to be accurately square with respect to an end face of the workpiece.

What is claimed is:

1. In a grinding machine for grinding rollers of rolling element bearings and like generally cylindrical workpieces having first and second opposed end faces, and comprising:

a machine bed, first and second supports carried on said machine bed, first and second mandrels respectively supported on said first and second supports, and axially rotatable about a common axis, said first mandrel being axially fixed with respect to said first support and said second mandrel being axially displaceable with respect to said second support, a first nose on said first mandrel directed towards said second mandrel, a second nose on said second mandrel directed towards said first mandrel, means for driving said first mandrel to rotate about said common axis, means for effecting axial displacement of said second mandrel with respect to said second support, a grinding wheel, grinding wheel support means supporting said grinding wheel for rotation about its axis and for displacement towards and away from a workpiece held between said noses on said first and second mandrels, the improvement comprising a support seat on said first nose of said mandrel, said support seat having a shape which is a surface of revolution about said common axis of rotation of said two mandrels, for receiving an end face of the workpiece which is shaped with the complementary surface of revolution, an abutment member having a convex surface of contact supported on said second nose of said second mandrel in such a way that it can freely move in all directions in a plane perpendicular to said common axis of rotation of said two mandrels, for engagement with the opposite end face of a workpiece from that engaged by said seat on said first nose of said first mandrel, and means for driving said second mandrel to rotate at the same speed and in the same direction at said first mandrel; said abutment member on said second nose comprises a ball, means defining a planar abutment surface, against which said ball is engageable, on the side of said ball remote from said first noise.

2. A grinding machine as in claim 1, wherein said ball is located within a cavity in said second nose the dimensions of said cavity transverse said common axis of rotation of said mandrels being greater than the diameter of said ball, means defining an annular opening in the end of said second nose facing said first nose, the centre of said opening lying on said common axis of rotation of said mandrels, said opening having a smaller diameter than that of said ball, resilient biasing means biasing said ball into contact with said opening in said end of said second nose, said means defining said plane abutment surface being spaced from said ball whereby said ball is movable between an advanced position in contact with said opening in said end of said second nose, to which position it is urged by said resilient biasing means, and a retracted position spaced from contact with said opening and in contact with said plane abutment surface, in which position it is displaceable transverse said common axis of rotation of said mandrels.

3. A grinding machine as in claim 2, wherein said resilient biasing means comprises a helical compression spring mounted in said nose, an annular member interposed between said ball and said helical compression spring transferring the force exerted by said compression spring to said ball.

4. A grinding machine as in claim 1, wherein said support seat on said first nose is formed as an annular surface.

5. A grinding machine as in claim 4 adapted for grinding workpieces having a part-spherical end face, wherein said annular surface of said support seat is a part-spherical surface of the centre of curvature of which lies on said common axis of rotation of said two mandrels.

6. A grinding machine as in claim 4 adapted for grinding workpieces having an end surface in the form of a truncated cone, wherein said annular surface of said support seat is frusto-conical with the axis thereof coincident with said common axis of rotation of said two mandrels.

7. A grinding machine as in claim 1, adapted for grinding workpieces having an end face which is substantially flat, wherein said support seat on said first nose is formed as a substantially flat surface perpendicular to said common axis of rotation of said mandrels.

8. A grinding machine as in claim 1, wherein said second mandrel is rotatably mounted within a double acting cylindrical piston movable axially parallel to said common axis of rotation of said two mandrels in a hydraulic cylinder carried on said second support.

9. A grinding machine as in claim 1, wherein said means for driving said first and second mandrels to rotate comprise two synchronous electric motors, one driving each mandrel, and common means for feeding an A.C. current supply to said two motors at the same frequency.

* * * * *